United States Patent [19]

Wirt et al.

[11] 4,013,130

[45] Mar. 22, 1927

[54] RIPPER TIP ASSEMBLY

[75] Inventors: Leon A. Wirt, Joliet; Kenneth A. Rhoads, East Peoria, both of Ill.

[73] Assignee: Caterpillar Tractor Co., Peoria, Ill.

[22] Filed: Nov. 4, 1974

[21] Appl. No.: 520,241

[52] U.S. Cl. ..... 172/719; 172/713; 37/142 R

[51] Int. Cl.[2] ..... A01B 23/02; E02F 9/28

[58] Field of Search ..... 172/719, 713; 37/141 R, 37/141 T, 142 R, 142 A

[56] References Cited

UNITED STATES PATENTS

| | | | |
|---|---|---|---|
| 2,847,921 | 8/1958 | Heckathorn | 172/713 X |
| 3,098,532 | 7/1963 | Dobbratz et al. | 172/719 |
| 3,203,488 | 8/1965 | Eastwood | 172/713 |
| 3,536,147 | 10/1970 | Norton et al. | 172/719 |
| 3,585,741 | 6/1971 | Heusler | 172/713 X |
| 3,897,642 | 8/1975 | Helton et al. | 172/713 |

*Primary Examiner*—George J. Marlo
*Attorney, Agent, or Firm*—Wegner, Stellman, McCord, Wiles & Wood

[57] ABSTRACT

A ripper of an earthworking apparatus includes a shank with a tapered, forwardly projecting lower end portion that has a blunt extremity, a detachable hollow shin protector which embraces the lower end portion of the shank, both to reinforce said lower end portion and to transfer some ripping forces to the upper portion of the shank which is stronger than the tapered lower end portion, and a one-piece detachable ripper tip which has a rearward mounting stub provided with spaced control surfaces that abut mating control surfaces on the shank and/or the shin protector to positively position the ripper tip and to transfer certain ripping forces through the shin protector to the upper portion of the shank.

30 Claims, 7 Drawing Figures

RIPPER TIP ASSEMBLY

BACKGROUND OF THE INVENTION

Heavy duty earthworking machines for ripping are provided with ripper means that includes a shank adjustably mounted on a pivoted arm which is hydraulically moved in and out of the ground, a replaceable ripper tip, and in some cases a replaceable guard which is commonly referred to as a shin protector which covers portions of the shank adjacent to the tip which would otherwise tend to wear away during ripping operations. The ripper tip and shin protector can be replaced when necessary, while the shank ordinarily has a useful life about as long as the machine if it is protected by a shin guard.

Ripper shanks commonly have a very heavy upper portion with a tapered end portion that extends diagonally downwardly from the upper part of the shank. Most tapered end portions of ripper shanks are generally wedge-shaped and fit into a complementary socket in the replaceable ripper tip. Such shank end portions are weaker than the upper shank and are frequently further weakened by a transverse bore for receiving a mounting pin for the removable ripper tip.

One U.S. patent discloses a means for transferring ripping forces from the tip to a higher location on the shank which is stronger; but even this does not entirely protect the relatively weak lower end portion of the ripper shank. In addition, the structure illustrated in the patent utilizes the conventional wedge-shaped ripper shank extremity which seats in a complementary socket in the replaceable ripper tip; and such parts are relatively difficult and expensive to manufacture due to the shape of the shank extremity and the need for a good fit between it and the ripper tooth socket.

Another U.S. patent discloses a device in which a replaceable ripper tip has a frusto-cylindrical mounting stub which seats in a socket, and the replaceable tip is held in place by a long bolt which extends through a bore in the lower end portion of the shank and screws into a threaded blind bore in the rear of the mounting stub. Yet another U.S. patent discloses another type of wedging mounting for a replaceable scarifying tooth, but that mounting presents the same manufacturing problems heretofore noted.

SUMMARY OF THE INVENTION

The present invention provides a new and improved mounting for a replaceable ripper tip, and the ripper tip mounting arrangement is one which cooperates with a shin protector that reinforces the lower end portion of the ripper shank and that also transfers certain ripping forces to a stronger upper portion of the shank.

The ripper tip mounting utilizes a mounting stub which enters a socket either in the shin guard or in the lower extremity of the shank or both. Control surfaces on the mounting stub abut complementary, or mating surfaces on the interior of the shin guard or in a cavity or socket formed in the extremity of the shank; and the relationship between the control surfaces and the mating surfaces abutted by them is such that ripping forces exerted on the replaceable ripper tip are transmitted to the upper portion of the shank.

In addition, the structure of the ripper tip mounting stub is such that the control surfaces may be planar, and may bear upon planar interior surfaces of the other elements of the combination so that the manufacture of the replaceable tip is relatively simple and inexpensive.

THE DRAWINGS

DETAILED DESCRIPTION OF THE INVENTION

Figure 1:
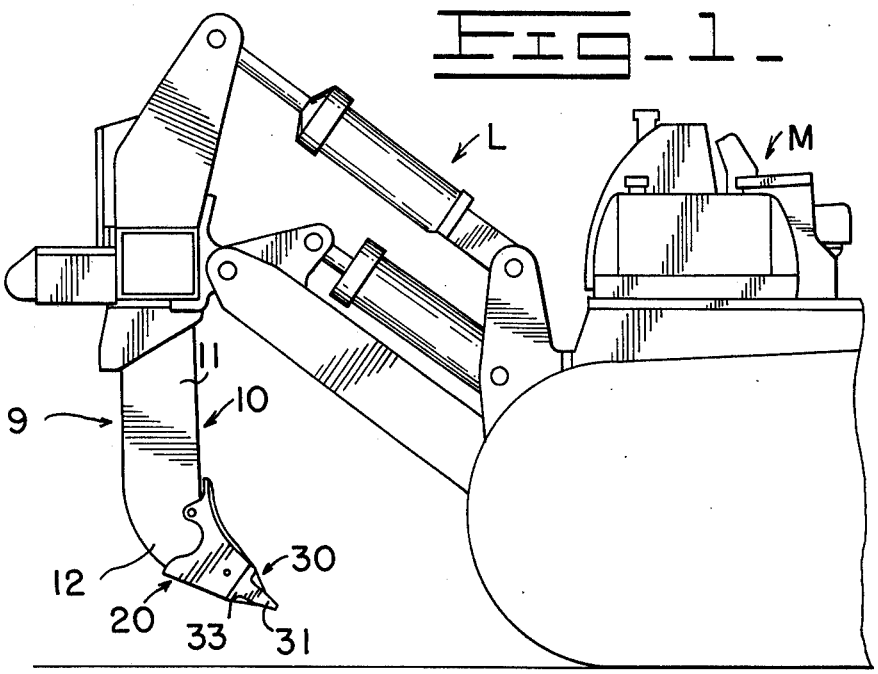
FIG. 1 is a fragmentary side elevational view of an earthworking machine equipped with the ripper assembly of the present invention.
Figure 2:
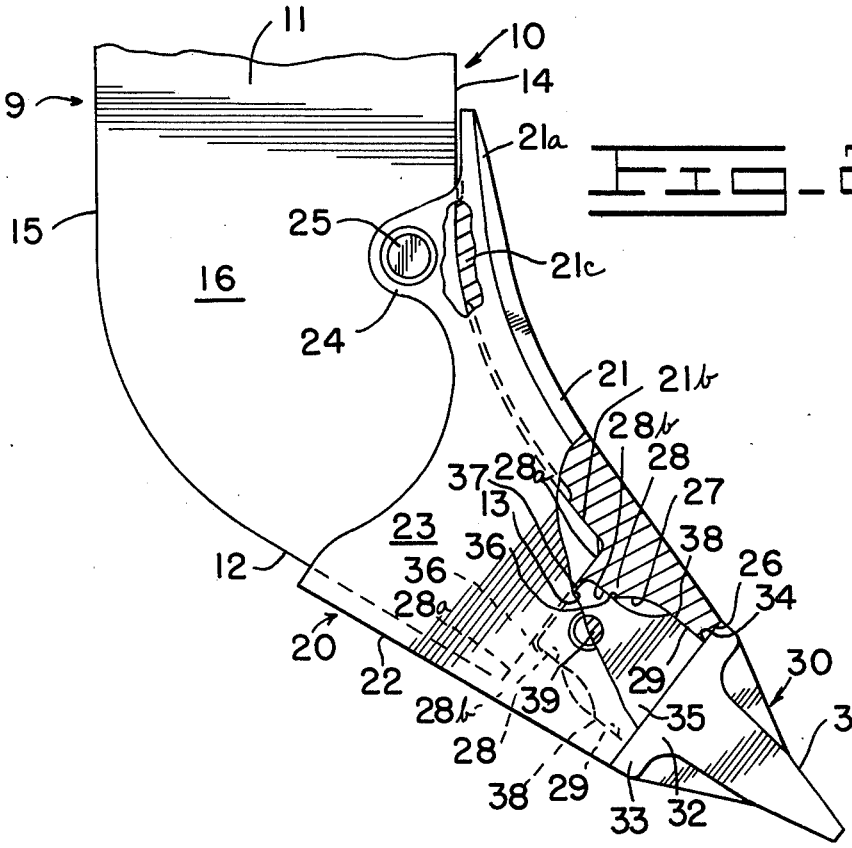
FIG. 2 is a fragmentary side elevation on an enlarged scale, and partly in section, of the lower end portion of the ripper structure of FIG. 1.

Referring first to FIGS. 1 and 2, an earthworking machine M has a conventional hydraulically manipulated linkage mechanism L which supports a ripper assembly, indicated generally at 9.

The ripper assembly 9 consists generally of a first element comprising a ripper shank, indicated generally at 10; a second element comprising a detachable hollow skin protector, indicated generally at 20; and a third element comprising a one-piece detachable ripper tip, indicated generally at 30.

The ripper shank 10 includes a strong, heavy upper portion 11 and a tapered, forwardly projecting lower end portion 12, which has a blunt extremity 13. The ripper shank has a front surface 14, a rear surface 15, and side surfaces 16.

The hollow shin protector 20 has a front wall 21, a rear wall 22 and side walls 23, and is internally shaped to closely embrace the tapered lower end portion 12 of the shank. The front wall 21 has an upwardly extending portion **21*a* which abuts the front surface 14 of the upper portion of the shank; with lower and upper pressure pads 21*b* and 21*c*, respectively, transferring ripping forces to the upper portion 11 of the shank. Ears 24 which project rearwardly from the upper extension 21*a* of the shin protector front wall 21 flank the sides 16 of the ripper shank and receive a mounting pin 25 by means of which the shin protector 20 is detachably secured to the shank 10**.

The shin protector 20 has a lower end 26 which is generally adjacent to the blunt extremity 13 of the ripper shank 10. The lower end portion of the hollow shin protector 20 provides a cavity 27 at the upper end of which are front and rear internal shoulder means 28 which have transverse faces **28*a* that abut the blunt extremity 13 of the shank. The shoulder means 28 also have facing longitudinal surfaces 28*b*; and in the lower end of the cavity 27 are facing longitudinal surfaces 29**.

The ripper tip 30 includes a forward ripper portion 31 and a ripper tip base 32 which is immediately adjacent to the lower end 26 of the shin protector 20 forward of the blunt extremity 13 of the shank. The base 32 has an external flange 33 that provides a rearwardly facing peripheral shoulder 34 that abuts the lower end 26 of the shin protector. The perimeter of the external flange 33 substantially matches the perimeter of the lower end 26 of the shin protector 20, so the ripper tip base 32 and the shin protector 20 have continuous front, rear, and side faces.

A mounting stub, indicated generally at 35, extends rearwardly from the ripper tip base 32 and is smaller in cross section than the base so that it may be received in the cavity 27 of the shin protector. The mounting stub 35 is provided with a plurality of spaced, external control surfaces, including first front and rear control surfaces 36 adjacent the distal end 37 of the stub which are adapted for abutting engagement with their respective longitudinal surfaces 28*b* of the shoulder means 28 under load; and second front and rear control surfaces 38 which are adapted for abutting engagement with the longitudinal cavity surfaces 29. Those skilled in the art will appreciate that due to manufacturing tolerances between respective ones of such control surfaces, and bending occurring during loading, some rocking movement may occur to bring certain ones of such control surfaces into contact while others may be disengaged under one loading condition and vice versa under another loading condition.

Aligned apertures in the mounting stub 35 and in the side walls 23 of the shin protector 20 receive a pin 39 which detachably fixes the position of the ripper tip 30 with reference to the shank 10 and the shin protector 20.

Axial working forces on the ripper tip 30 are transmitted endwise through the flange 33 of the ripper tip and through the shoulders 28 of the shin protector into the lower end portion 12 of the shank through the blunt extremity 13 thereof. The more potentially damaging bending forces on the ripper tip 30 are transmitted through the control surfaces 36 and 38 of the mounting stub 35 into the shoulder means 28 of the shin guard. Such forces are then transferred into the lower end portion 12 of the shank partly through the transverse faces 28*a* and the blunt extremity 13; and partly through the front and rear walls 21 and 22 of the shin protector 20 and the front and rear faces 14 and 15 of the shank.

Figure 3:
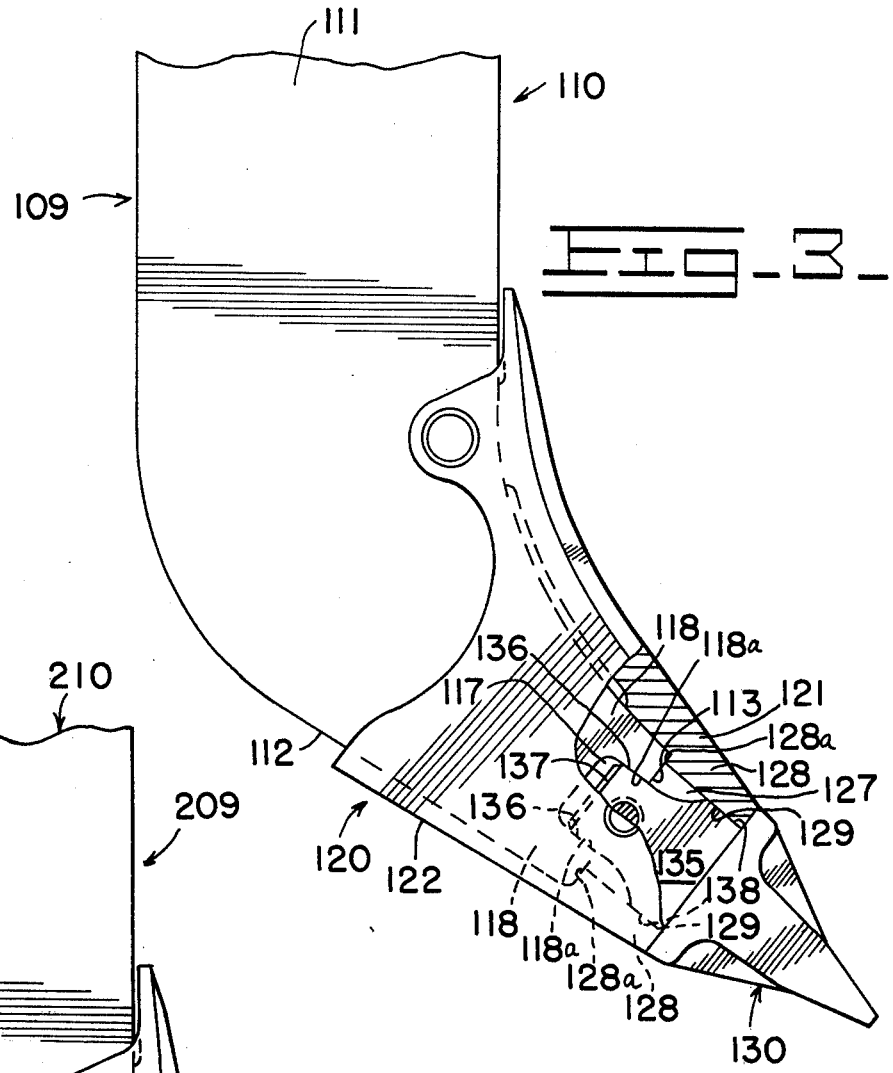
FIG. 3 is a view similar to FIG. 2 illustrating a first modification of the structure.

Referring now to the first alternative embodiment illustrated in FIG. 3, since many parts of the embodiment of FIG. 3 are identical to those of FIG. 2, they will be given corresponding reference numerals 100 numbers higher; and many of the particular elements will be numbered to correspond to their counterparts in FIG. 2 even though they may not be mentioned in the following detailed description which will be directed generally to the differences between the structure of FIG. 3 and that of FIG. 2.

A ripper tip assembly, indicated generally at 109, includes a ripper shank 110 which differs in certain respects from the shank 10; a hollow shin protector 120 which also differs in certain respects from the shin protector 20; and a ripper tip 130 which is identical with the ripper tip 30.

The ripper shank 110 has a socket 117 in its blunt extremity 113 which takes the form of a transverse slot defined by front and rear walls 118 which have longitudinal front and rear facing surfaces 118*a* which are abutted by the first guide surfaces 136 adjacent the distal end 137 of the mounting stub 135.

The shin guard 120 has inner shoulders 128 which are much shallower than the shoulders 28 of the embodiment of FIG. 2; but those shoulders still provide transverse surfaces 128*a* which abut the extremity 113 of the shank 111 at the ends of the front and rear walls 118.

As in the first form of the device, the second control surfaces 138 of the mounting stub 135 abut longitudinal front and rear surfaces 129 of a cavity 127 which is in the lower end portion of the shin protector 120.

Accordingly, the only significant difference between the structure of FIG. 2 and that of FIG. 3 is that in the former both of the spaced sets of control surfaces of the mounting stub are engaged by mating longitudinal surfaces of the shin protector 20; while in the second embodiment some of the control surfaces abut longitudinal surfaces in the shin protector 120 while others abut longitudinal surfaces in the cavity, or slot 117 in the end of the ripper shank. The front and rear walls 121 and 122 of the shin protector 120 closely embrace the front and rear walls 118 of the cavity 117 to reinforce those walls against forces tending to spread them.

Figure 4:
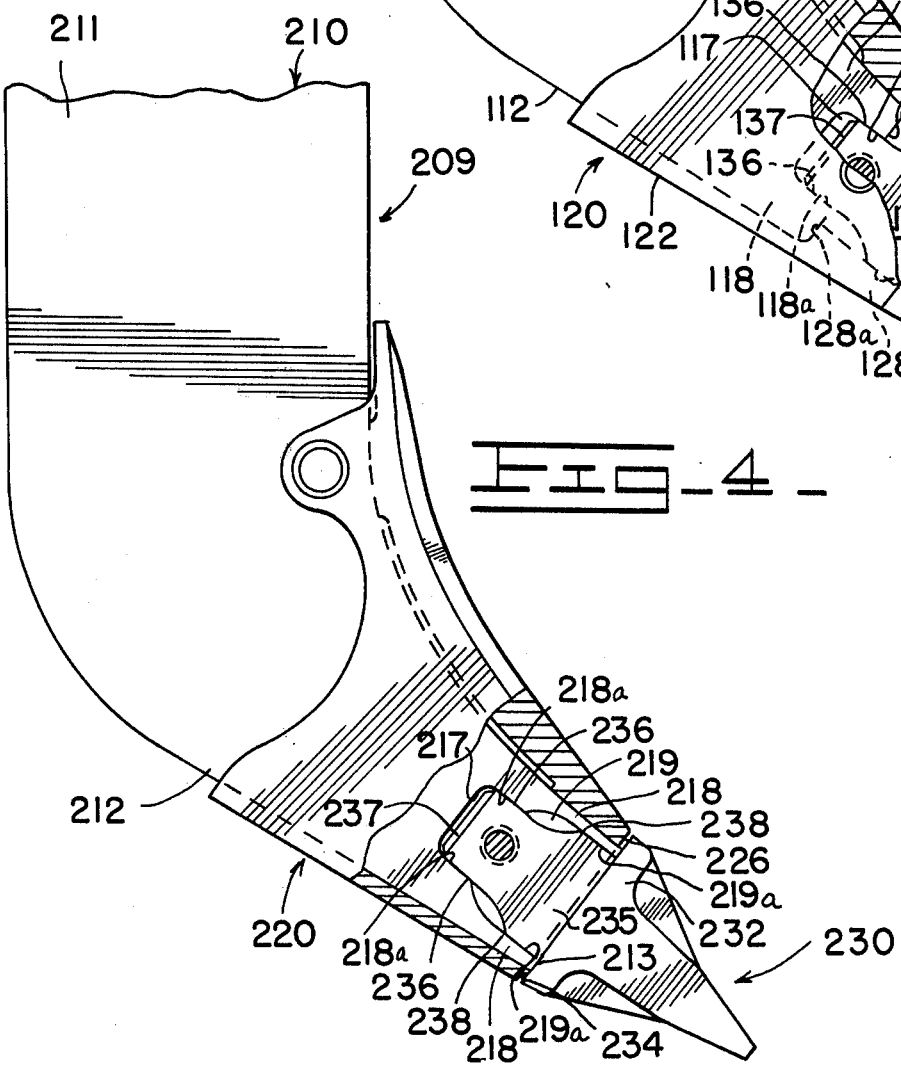
FIG. 4 is a view similar to FIG. 2 showing a second modification of the structure.

Referring now to FIG. 4, the ripper assembly 209 which constitutes the third embodiment of the invention includes a ripper shank 210, a shin protector 210, and a ripper tip 230.

In this embodiment a ripper shank 210 has a cavity 219 formed in its lower end which is defined by front and rear wall portions 218, and it also has longitudinal front and rear wall inner surfaces 219*a* adjacent the extremity 213 of the ripper shank which mate with second control surfaces 238 of a ripper tip mounting stub 235. The upper, or rear portion of the cavity 219 consists of a narrower, slot-like portion 217 having longitudinal inner wall surfaces 218*a* which abut first control surfaces 236 of the mounting stub 235.

The extremity 213 of the ripper shank 210 bears directly against the base 232 of the ripper tip; and the lower end 226 of the shin protector 220 is spaced very slightly from the peripheral shoulder 234 of the ripper tip base 232.

Except in the respects above described, the ripper assembly 209 is the same, and functions in the same way, as do the ripper assemblies 9 and 109.

Figure 5:
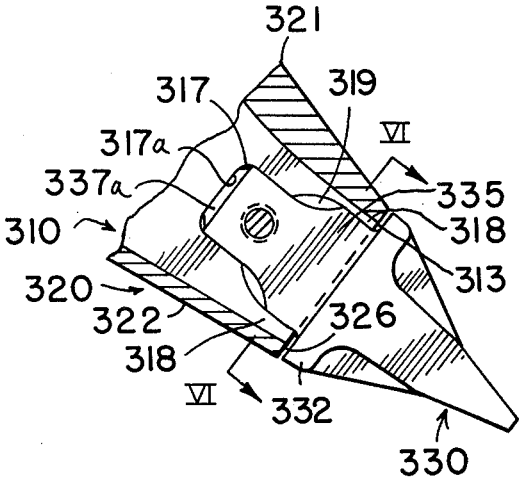
FIG. 5 is a fragmentary view of a third modification taken substantially as indicated along the line 5—5 of FIG. 6.

Referring now to FIG. 5, the fourth embodiment of the invention is identical with the third embodiment of FIG. 4, with one exception which will now be described. In this case a ripper tip 330 has a mounting stub 335 with a slightly longitudinally extended and beveled distal end portion 337*a* which seats against the end 317*a* of a slot 317; and the extremity 313 of a ripper shank 210 is spaced slightly from the base 332 of the ripper tip, and is flush with the lower end 326 of a shin protector 320.

Figure 6:
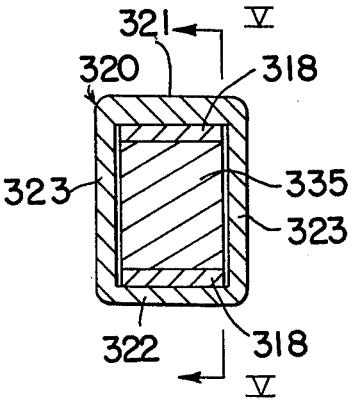
FIG. 6 is a transverse sectional view taken substantially as indicated along the line 6—6 of FIG. 5.

FIG. 6, a transverse section through FIG. 5, shows that in this embodiment of the invention the mounting stub 335 extends the full width of the lower end portion of the ripper shank 310, and is closely confined between the side walls 323 of the shin protector 320. Thus, in the embodiment of FIG. 5, and also in the embodiments of FIGS. 3 and 4, the slot that receives the distal end portion of the mounting stub is cut the entire width of the ripper shank; and likewise in the embodiments of FIGS. 4 and 5 the cavities 219 and 319, respectively, are cut the entire width of the ripper shank.

Figure 7:
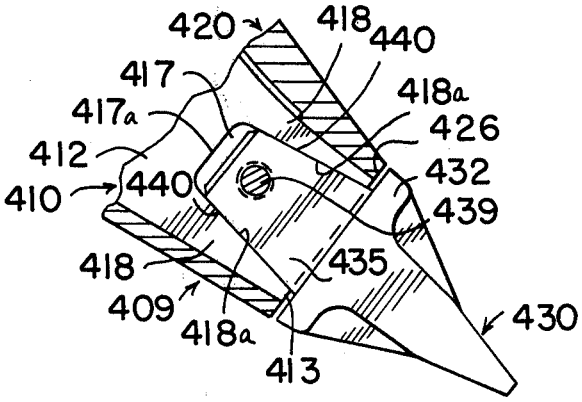
FIG. 7 is a view similar to FIG. 5 illustrating a fourth modification of the apparatus.

In all five embodiments of the invention, including the embodiment of FIG. 7 not yet described, the mounting stub of the ripper tip extends the full width of the lower end portion of the ripper shank and is held firmly between the sides of the shin protector.

Referring now to FIG. 7, the ripper assembly 409 of the fifth embodiment of the invention includes a ripper shank 410 the lower end portion 412 of which is provided with a slot 417 defined by front and rear walls 418 which have inner surfaces 418*a* that converge toward the end 417*a* of the slot.

A ripper tip 430 has a mounting stub 435 provided with rearwardly converging front and rear control surfaces 440 which match with and abut the inner wall surfaces 418*a;* and the mounting stub 435 enters the slot 417 far enough to be fastened with a pin 439.

As in the embodiment of FIG. 5, a shin protector 420 has its lower end 426 flush with the extremity 413 of the shank 410, and both are spaced slightly from the base 432 of the ripper tip.

The foregoing detailed description is given for clearness of understanding only and no unnecessary limitations should be understood therefrom, as modifications will be obvious to those skilled in the art.

We claim:

1. In an earthworking apparatus, a ripper assembly comprising, in combination:

a first element comprising a ripper shank which has an upper portion and a tapered, forwardly projecting lower end portion which has front and rear faces and side faces, said lower end portion having a first transverse surface providing a blunt lower extremity;

a second element comprising a detachable hollow shin protector which has front and rear walls and side walls which closely embrace and reinforce the tapered lower end portion of the shank, said second element having a lower end portion with a second transverse surface adjacent said first tranverse surface;

a third element comprising a one-piece detachable ripper tip which includes a forward ripper portion, a ripper tip base immediately adjacent the lower end of the shin protector forward of the blunt extremity of the shank, said base having an external flange providing a peripheral shoulder with a generally planar upper surface the perimeter of which substantially matches the perimeter of said lower end of the shin protector, and a mounting stub which is substantially rectangular in cross section and extends rearwardly from said base and is smaller in cross section than the base, said mounting stub being provided with a longitudinal forward external control surface and a longitudinal rearward external control surface each of which abuts a mating internal surface of at least one of said first and second elements of the combination to position the ripper tip and transmit ripping forces from the tip into the shank and the shin protector;

means detachably securing the shin protector to the shank;

and means detachably positioning the ripper tip with reference to the shank and the shin protector.

2. The combination of claim 1 in which the external control surfaces of the mounting stub are planar.

3. The combination of claim 1 in which the hollow shin protector includes a lower end portion in which its front and rear walls and side walls define a cavity which is below the blunt lower extremity of the shank and receives the entire mounting stub, and the external control surfaces of the mounting stub abut mating surfaces of said front and rear walls in said cavity.

4. The combination of claim 3 in which the front and rear walls of the shin protector have internal shoulder means with transverse faces that abut the blunt lower extremity of the shank, and said shoulder means has longitudinal internal front and rear surfaces which provide certain of said mating surfaces.

5. The combination of claim 1 in which the lower end of the shin protector abuts the peripheral shoulder.

6. The combination of claim 5 in which the front and rear walls of the shin protector each has an internal shoulder spaced from its lower end which has a transverse face that abuts the blunt extremity of the shank, and in which the mounting stub has a front longitudinal control surface and a rear longitudinal control surface adjacent the ripper tip base which abut longitudinal internal surfaces of said front and rear walls below said internal shoulders.

7. The combination of claim 6 in which each of said internal shoulders has a longitudinal surface abutted by a control surface adjacent the distal end of the mounting stub.

8. The combination of claim 6 in which there is a slot in the blunt extremity of the shank defined by front and rear walls having longitudinal internal surfaces, and the distal end portion of the mounting stub extends into said slot and has a control surface abutting each of said internal surfaces of said walls.

9. The combination of claim 1 in which there is a slot extending upwards in the extremity of the shank which is defined by front and rear walls that have internal surfaces, the mounting stub extends into said slot and has its forward and rearward control surfaces abutting said internal surfaces of said front and rear walls, and the shin protector has front and rear walls that snugly embrace the shank at said front and rear walls of the slot.

10. The combination of claim 9 in which each of the front and rear walls of the slot has a shoulder between its ends with longitudinal surfaces abutted by control surfaces on the distal end portion of the mounting stub, and longitudinal internal surfaces of said front and rear walls adjacent the outer end of the slot below the shoulders are abutted by front and rear control surfaces on the mounting stub adjacent the ripper tip base.

11. The combination of claim 10 in which the upper distal end of the mounting stub abuts the upper end of the slot and the peripheral shoulder is spaced from the blunt lower extremity of the shank.

12. The combination of claim 10 in which the peripheral shoulder abuts the blunt lower extremity of the shank and the distal end of the mounting stub is spaced from the upper end of the slot.

13. The combination of claim 9 in which the longitudinal forward and rearward control surfaces of the mounting stub are generally planar and converge toward the distal end of said stub, and the front and rear walls of the slot have converging inner surfaces abutted by said control surfaces.

14. The combination of claim 13 in which the peripheral shoulder is spaced slightly from the extremity of the shank and from the lower end of the shin protector.

15. The combination of claim 14 in which the distal end of the mounting stub is spaced slightly from the upper end of the slot.

16. The combination of claim 1 in which the mounting stub has first longitudinal control surfaces on the front and rear of its distal end portion and second longitudinal control surfaces spaced from said first control surfaces on said front and rear adjacent the ripper tip base.

17. The combination of claim 16 in which the hollow shin protector has front and rear internal shoulder means with transverse surfaces abutting the extremity of the shank, said internal shoulder means defining a cavity in the lower end portion of the shin protector, the lower end of the shin protector abuts the peripheral shoulder, the mounting stub is received in said cavity, and the second longitudinal control surfaces of the mounting stub abut front and rear inner surfaces of the cavity.

18. The combination of claim 17 in which the distal end portion of the mounting stub is between the internal shoulder means, and said internal shoulder means have opposed longitudinal front and rear surfaces abutted by the first longitudinal control surfaces on the mounting stub.

19. The combination of claim 17 in which there is a slot extending upwardly in the extremity of the shank which is defined by front and rear walls that have opposed internal surfaces, and in which the distal end portion of the mounting stub is received in said slot with the first control surfaces abutting said inner surfaces.

20. The combination of claim 16 in which there is a slot in the extremity of the shank defined by front and rear walls that define an upper portion of a first width which has upper front and rear internal longitudinal surfaces and a lower portion of greater width which has lower front and rear internal longitudinal surfaces, the mounting stub extends into said slot, the first longitudinal control surfaces abut said upper internal surfaces and the second longitudinal control surfaces abut said lower internal surfaces, the shin protector has front and rear walls that snugly embrace the shank at the walls of the slot and the lower end of said shin protector is spaced from the peripheral shoulder.

21. The combination of claim 20 in which the distal end of the mounting stub abuts the upper end of the slot and the peripheral shoulder is spaced from the extremity of the shank.

22. The combination of claim 20 in which the peripheral shoulder abuts the extremity of the shank and the distal end of the mounting stub is spaced from the end of the cavity.

23. The combination of claim 1 in which the first, second and third elements are generally rectangular in cross section, the mounting stub is smaller from front to rear than the extremity of the shank and has the same transverse dimension as said extremity, and in which the shin protector has lateral sides closely confining the sides of said mounting stub.

24. The combination of claim 23 in which the shin protector has a front wall provided with an upward extension that abuts the upper portion of the shank to transfer ripping forces to said upper portion, and the longitudinal forward and rearward control surfaces on the mounting stub cooperate with the mating surfaces to transmit ripping forces through the shin protector to said upper portion of the shank.

25. The combination of claim 1 in which the shin protector has a front wall provided with an upward extension that abuts the upper portion of the shank to transfer ripping forces to said upper portion, and the longitudinal forward rearward control surfaces on the mounting stub cooperate with the mating surfaces to transmit ripping forces through the shin protector to said upper portion of the shank.

26. In an earthworking apparatus, a ripper assembly comprising, in combination:

a first element comprising a ripper shank which has an upper portion and a tapered, forwardly projecting lower end portion which has front and rear faces and side faces, said lower end portion having a blunt lower extremity;

a second element comprising a detachable hollow shin protector which has front and rear walls and side walls which closely embraces and reinforces the tapered lower end portion of the shank, said second element having a lower end adjacent said blunt extremity;

a third element comprising a one-piece detachable ripper tip which includes a forward ripper portion, a ripper tip base immediately adjacent the lower end of the shin protector forward of the blunt extremity of the shank, said base having an external flange providing a peripheral shoulder with a generally planar upper surface the perimeter of which substantially matches the perimeter of said lower end of the shin protector, and a mounting stub which is substantially rectangular in cross section and extends rearwardly from said base and is smaller in cross section than the base, said mounting stub having a generally planar distal end surface, and said mounting stub having first front and rear control surfaces at its distal end portion and second front and rear control surfaces adjacent the ripper tip base, said first control surfaces and said second control surfaces abutting spaced internal front and rear surfaces of at least one of said first and second elements of the combination, and one of said generally planar surfaces abutting a transverse surface of one of said first and second elements of the combination to position the ripper tip and transmit ripping forces from the tip into the shank and the shin protector;

means detachably securing the shin protector to the shank;

and means detachably positioning the ripper tip with reference to the shank and the shin protector.

27. The combination of claim 26 in which the upper surface of the peripheral shoulder abuts said transverse surface of said one of said first and second elements of the combination.

28. The combination of claim 27 in which the upper surface of the peripheral shoulder abuts the lower end of the shin protector.

29. The combination of claim 27 in which the upper surface of the peripheral should abuts the blunt lower extremity of the shank.

30. The combination of claim 26 in which there is a slot extending upwardly in the lower extremity of the shank and terminating in a transverse surface, and in which the planar distal end surface of the mounting stub abuts said transverse surface.

* * * * *

UNITED STATES PATENT AND TRADEMARK OFFICE

CERTIFICATE OF CORRECTION

PATENT NO. : 4,013,130

DATED : Mar. 22, 1927

INVENTOR(S) : Leon A. Wirt and Kenneth A. Rhoads

It is certified that error appears in the above-identified patent and that said Letters Patent are hereby corrected as shown below:

Col. 6, line 45, delete "upper"

Col. 8, line 57, "should" should be --shoulder--

Issue date of patent should be --Mar. 22, 1977--.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*